United States Patent [19]

Wessel

[11] 4,244,080

[45] Jan. 13, 1981

[54] SUCTION NOZZLES FOR VACUUM CLEANERS

[76] Inventor: Hans Wessel, Wildbergerhutte, D-5226 Reichshof 31, Fed. Rep. of Germany

[21] Appl. No.: 67,519

[22] Filed: Aug. 17, 1979

[30] Foreign Application Priority Data

May 3, 1979 [DE] Fed. Rep. of Germany ... 7912825[U]

[51] Int. Cl.[3] ..... A47L 9/00; A47L 9/04

[52] U.S. Cl. ..... 15/325; 15/354; 15/398; 15/401; 285/7; 285/276

[58] Field of Search ..... 15/325, 354, 355, 398, 15/401, 415 R; 285/7, 276, 321

[56] References Cited

U.S. PATENT DOCUMENTS

| | | | |
|---|---|---|---|
| 982,640 | 1/1911 | Spencer | 15/415 |
| 1,527,383 | 2/1925 | Solliday | 285/276 X |
| 1,695,246 | 12/1928 | Gammeter | 15/325 |
| 1,806,168 | 5/1931 | Kirby | 15/354 |
| 2,318,317 | 5/1943 | Lofgren | 15/398 X |
| 2,734,215 | 2/1956 | Wilson | 15/325 |
| 2,841,812 | 7/1958 | Laechowicz | 15/355 |
| 3,286,296 | 11/1966 | Waters | 15/325 X |
| 3,290,068 | 12/1966 | Jackson | 285/276 |
| 4,164,055 | 8/1979 | Townsend | 15/321 |

FOREIGN PATENT DOCUMENTS

| | | | |
|---|---|---|---|
| 2005499 | 8/1971 | Fed. Rep. of Germany | 15/393 |

*Primary Examiner*—Christopher K. Moore
*Attorney, Agent, or Firm*—Young & Thompson

[57] ABSTRACT

A suction nozzle for a vacuum cleaner runs on rollers (4) at the ends of a suction passage (24) whose front and rear margins are defined by replaceable insert strips (7', 8', 9'; 7, 8, 9). The rollers have a cranked axle bar (5) supported at intervals by open bushings (23) of different orientations, integral with the nozzle body (1). At the ends of the suction passage (24) gaps between the rollers (4) and the front strips (7, 8, 9) create lateral suction. A plastic covering (2) caps the nozzle body (1) and is secured by integrally molded studs (14).

7 Claims, 6 Drawing Figures

SUCTION NOZZLES FOR VACUUM CLEANERS

This invention relates to suction nozzles for vacuum cleaners.

Suction nozzles for industrial and commercial vacuum cleaners generally have a housing with a swivel socket of various diameters for connecting to suction pipes. They also usually have brush blocks or rubber strips which can be interchangeably inserted in the housing. For moving easily over work surfaces, such nozzles are normally equipped with rollers whose height can be adjusted by a knob acting on a cranked axle.

One notable disadvantage of known nozzles is the inadequate lateral suction, i.e. it is impossible to clean sufficiently close to skirting boards, for example. Furthermore, the housing is usually complex in construction and is composed of several components which have to be screwed or otherwise connected together. The swivel sockets are subject to heavy wear, and the mounting of the cranked axles in the housing is costly.

The problem underlying the invention is to produce a suction nozzle which does not have these disadvantages can which can be easily and rapidly assembled.

According to the present invention there is provided a suction nozzle for a vacuum cleaner comprising a nozzle body adapted on its underside to receive interchangeable strips which define the front and rear margins of a suction passage, rollers at each end of said passage cooperating with the front strip(s) to form lateral suction gaps communicating with said passage and with the rear strip(s) laterally to confine the latter, a cranked axle bar for said rollers carried in open bushings of different orientations and integrally formed with said body, means for acting on said axle bar to adjust the height of the rollers, and a swivel socket communicating with said passage for connection to suction apparatus, the socket having two mutually rotatable parts, one fixed with the nozzle body, a first socket part carrying a bearing ring which receives a spring washer which engages the second socket part, axially to locate the latter with respect to said one socket part.

For a better understanding of the invention an embodiment thereof will now be described, by way of example, with reference to the accompanying drawings, in which.

Figures 1, 2:
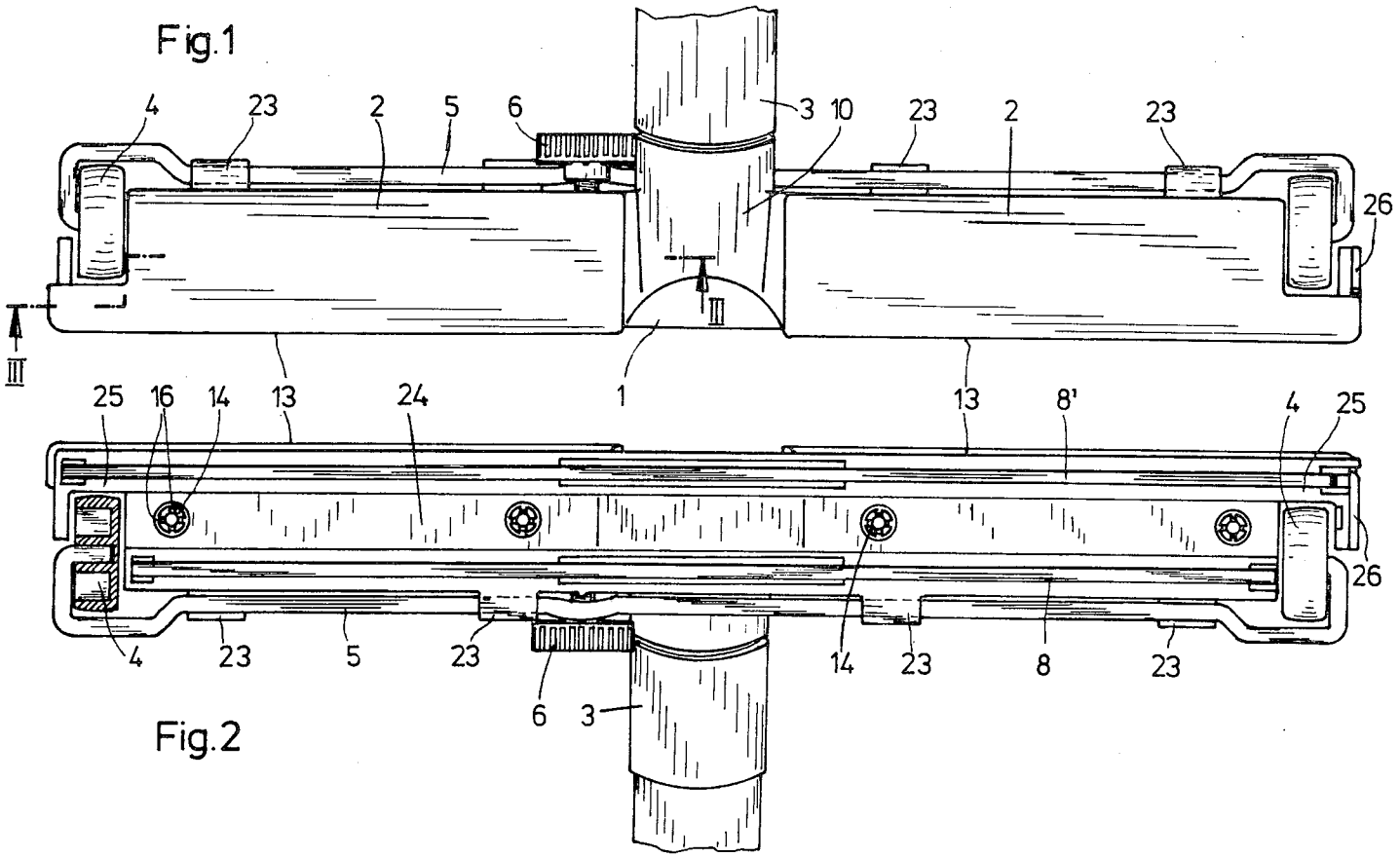
FIG. 1 is a top plan view of a suction nozzle.
FIG. 2 is an underneath plan view of the nozzle.
Figure 4:
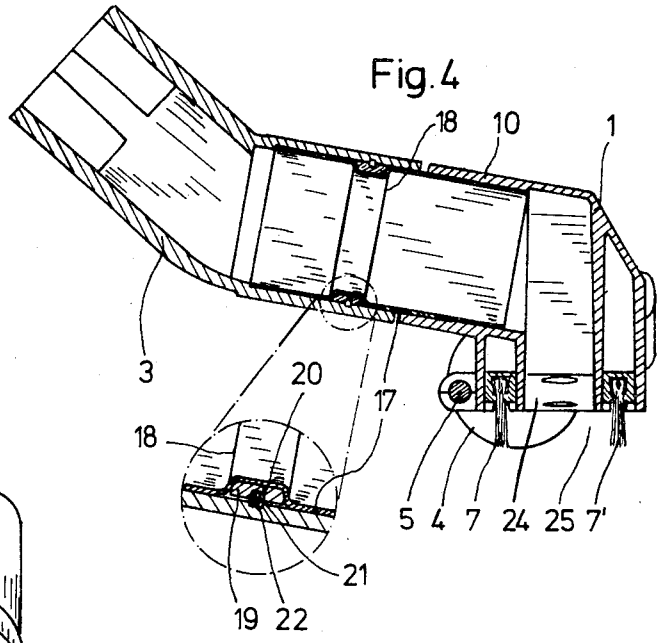
FIG. 4 is a section through the nozzle on the line IV—IV of FIG. 3 with an enlarged detail.
Figure 6:
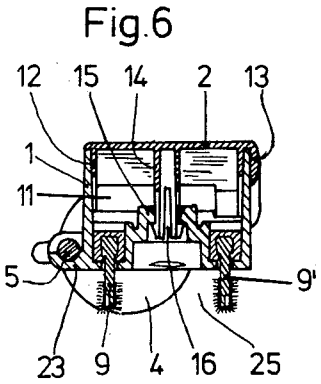
FIG. 6 is a section ont he line VI—VI of FIG. 3.
Figure 5:
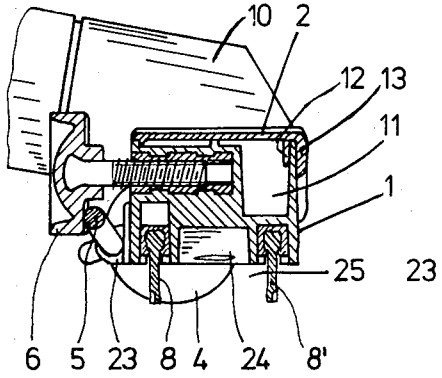
FIG. 5 is a section on the line V—V of FIG. 3.
Figure 3:
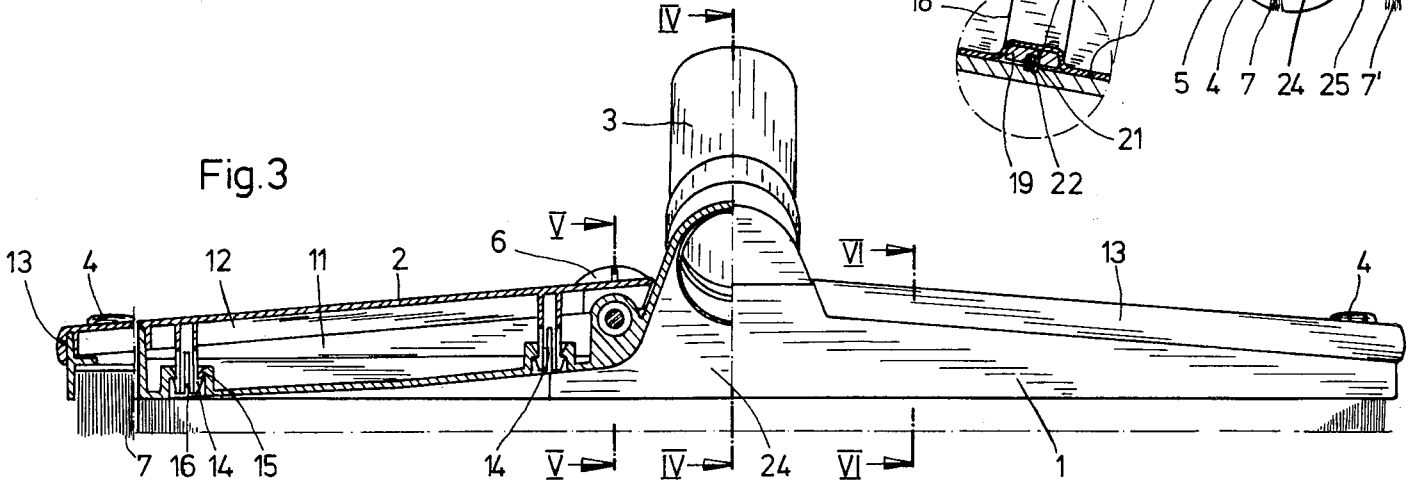
FIG. 3 is a front view of the nozzle, partly in section on the line III—III of FIG. 1.

The suction nozzle has a body 1 of pressure-cast aluminum capped by plastic laminated covers 2, and a swivel socket 3. For easy movement over work surfaces there are provided two rollers 4, which are mounted by means of a cranked axle bar 5 and whose height can be adjusted by a knurled knob 6. Flexible, skirt-like elements are secured along the front and rear of the underside of the body and these may take the form of brush strips 7 and 7′ (FIGS. 3 and 4), rubber strips 8 and 8′ (FIG. 5), or so-called rapid strips 9 and 9′ (FIG. 6) which are rubber strips with bristles. These elements may be interchangeably inserted in grooves as desired.

The covers 2 are located to either side of a connecting socket 10 and cap the cavities 11 created by the cast shape of the body. They are fixed in position by flanges 12 which extend around the inside of the nozzle body 1 and which locate therein. The front and the sides of the covers 2 have further flanges 13, rounded to form a buffer rim. They provide additional locating and securing means. More positive attachment is provided by two downwardly projecting barbed studs 14 molded on each cover 2, which are captive in corresponding apertures 15 in the nozzle body 1. In order to allow the enlarged stud heads to penetrate the apertures 15, the studs 14 are formed with slits 16, which gives resiliency.

In order to obtain greater than normal resistance to wear in the swivel socket 3, a connecting press-in sleeve 17 inserted in socket 10 is formed beyond the socket 10 with an annular groove 18, open radially outwardly, in which a split nylon bearing ring 19 is inserted. This ring 19 itself has an outwardly facing groove 20 for accepting a spring washer 21, which engages in an annular groove 22 in the inner cylindrical wall of the swivel socket 3. This arrangement provides axial location while allowing mutual rotation, and absorbs the axial forces which occur at this zone.

The axle bar 5 for the rollers 4 is carried by semi-cylindrical bearing bushings 23 cast integrally with the nozzle body 1. Each bushing faces the opposite way from the adjacent one on its side of the nozzle, so that the bar is positively captured. The latter can easily be fitted by inserting and turning, in spite of its many bends, and is then secure. Screwed-on bearings are unnecessary with this arrangement.

The rollers 4 are so mounted on the axle bar 5 that they partly block the ends of suction passage 24, but in combination with the front insert strips 7′, 8′ or 9′ they do form end gaps 25 by which lateral suction is achieved.

The front strips 7′, 8′ or 9′ are mounted in the nozzle body 1 by being inserted in the groove from one end, where they are retained by a pivoted catch 26. The rear insert strips 7, 8 or 9 are secured against lateral shifting in their groove by the rollers 4. To replace them, the rollers are sufficiently shifted by the adjusting knob 6 to clear the ends of the rear groove, allowing the old strip to be eased out and the new one to be fitted.

What is claimed is:

1. A suction nozzle for a vacuum cleaner comprising a nozzle body adapted on its underside to receive interchangeable strips which define the front and rear margins of a suction passage, rollers at each end of said passage cooperating with a front said strip to form lateral suction gaps communicating with said passage, and with a rear said strip to laterally confine the latter, a cranked axle bar for said rollers carried in open bushings of different orientations, said bushings being integrally formed with said body, means for acting on said axle bar to adjust the height of the rollers, and a swivel socket communicating with said passage for connection to suction apparatus, the socket having two mutually rotatable parts, one said part being fixed with the nozzle body, a first one of said socket parts carrying a bearing ring which receives a spring washer which engages a second one of said socket parts to locate the latter axially with respect to said first socket part.

2. A suction nozzle as claimed in claim 1, wherein said one socket part is a sleeve partially pressed into said nozzle body and partially entered within the other socket part.

3. A suction nozzle as claimed in claim 2, wherein said bearing ring is a split ring carried in a groove in said sleeve, the bearing ring itself having a groove to receive the spring washer.

4. A suction nozzle as claimed in claim 1, wherein said bearing ring is of nylon.

5. A suction nozzle as claimed in claim 1, the nozzle body being of cast metal having cavities in its upper surface, and a detachable plastic covering on said nozzle body that closes said cavities.

6. A suction nozzle as claimed in claim 5, wherein the covering provides a buffer rim.

7. A suction nozzle as claimed in claim 5, wherein the covering is provided with barbed studs, split for resiliency, to engage in and be caught by apertures in the nozzle body.

* * * * *